US005432410A

United States Patent [19]

Yamada et al.

[11] Patent Number: 5,432,410

[45] Date of Patent: Jul. 11, 1995

[54] ELECTRONIC FLASHING DEVICE HAVING A SPECIFIC TYPE OF MAIN CAPACITOR SENSING CIRCUIT

[75] Inventors: Hiroshi Yamada; Akira Watanabe, both of Hachioji, Japan

[73] Assignee: Olympus Optical Co., Ltd., Tokyo, Japan

[21] Appl. No.: 205,774

[22] Filed: Mar. 4, 1994

Related U.S. Application Data

[63] Continuation of Ser. No. 851,824, Mar. 16, 1992, abandoned.

[30] Foreign Application Priority Data

Mar. 19, 1991 [JP] Japan ..... 3-054872

[51] Int. Cl.[6] ..... H05B 37/02

[52] U.S. Cl. ..... 315/241 P; 354/145.1

[58] Field of Search ..... 315/241 P, 241 S, 307, 315/241 R; 354/145.1, 413

[56] References Cited

U.S. PATENT DOCUMENTS 3,162,786 12/1964 Kapteyn ..... 315/241 P
4,145,637 3/1979 Giese ..... 315/241 P
5,034,662 7/1991 Nishida et al. ..... 315/241 P

FOREIGN PATENT DOCUMENTS 193131 7/1990 Japan ..... 315/241 P

*Primary Examiner*—Robert J. Pascal
*Assistant Examiner*—Michael B. Shingleton
*Attorney, Agent, or Firm*—Louis Weinstein

[57] ABSTRACT

A series circuit of a pass condenser and a neon lamp operate as a voltage detecting device. A resistance voltage dividing circuit has a connecting point between voltage dividing resistances which are connected to the connecting point between the pass condenser and the neon lamp of the voltage detecting device. The series circuit and resistance voltage dividing circuits are provided between a power source boosting circuit and a main condenser so that, when the main condenser has been fully charged, the neon lamp will conduct, causing a charge completion signal to be outputted and thereby the charging operation will be stopped. When the charge voltage of the main condenser is a flash possible voltage, the neon lamp will conduct for only a short time and the charge completion signal will be output accordingly for only a short time in the form of a pulse. The voltage detecting device thus outputs three types of signals over a single output line to indicate one of three possible charging states.

44 Claims, 9 Drawing Sheets

ELECTRONIC FLASHING DEVICE HAVING A SPECIFIC TYPE OF MAIN CAPACITOR SENSING CIRCUIT

This is a continuation of application Ser. No. 07/851,824, filed Mar. 16, 1992, now abandoned.

BACKGROUND OF THE INVENTION

1. Field of the Invention

This invention relates to electronic flashing devices and more particularly to sensing a charge voltage of a main condenser in a flashing circuit of an electronic flashing device used in photographing with a camera or the like.

2. Related Art Statement

As is well known, in charging a main condenser in an electronic flashing device, such as a strobo device, in order to reduce the charging time, the output voltage of a boosting transformer is often set higher than the actually used voltage, to reduce the charging time by using a steep rise of the charging curve of the main condenser. For example, note the charging characteristic diagram of FIG. 9 in which a charging time T is taken on the abscissa and an output voltage V is taken on the ordinate. When a transformer of a high output voltage is used, and having a charging curve a, the charging time T required to reach the used voltage is short as shown by $T_1$. When using a transformer having the same output voltage as the used voltage, as shown by charging curve b, the charging time T will be long as represented $T_2$.

When a transformer of such high output voltage is used, there will be a merit that the charging voltage is short. In such case, unless the charging voltage is controlled, the charging voltage will rise with time to exceed the resisting voltage of the main condenser or the resisting voltage of the flashing discharge tube in which as Xe gas is enclosed. Therefore, when such a transformer is used, it will be necessary to stop the charging operation when the used voltage is reached and it will therefore be necessary to sense the charging voltage of the main condenser. In order to sense the charging voltage, a voltage sensing device such as a neon lamp or Zener diode has generally been used.

As shown in FIG. 10, the conventional voltage sensing circuit using a neon lamp comprises a series circuit of a resistance $R_1$ neon lamp Ne and resistances $R_2$ and $R_3$ connected in parallel with a main condenser C. A voltage rise controlling signal (mentioned as a CHRG signal hereinafter) is set to an "L" level, and serves as a charge starting signal. The output voltage of a battery is boosted by a power source circuit and is coupled through a diode D to a main condenser C, which is charged by the boosted voltage. When the voltage of the main condenser C rises and the charge voltage reaches the lighting voltage of the neon lamp NE, lamp Ne lights to display the completion of charging, transistor Q is switched on by the lighting current flowing through lamp Ne, the signal is inverted by an invertor I, i.e. the CHRG signal changes to an "H" level, representing a charge completion signal, stopping the charging operation.

In the voltage sensing circuit of FIG. 10, when the lighting voltage of the neon lamp Ne is selected to be a desired charge stopping voltage, the charge voltage can be controlled.

In the conventional voltage sensing circuit of FIG. 11, the above-mentioned neon lamp Ne is replaced with a Zener diode TD. The other components of FIG. 11 are the same as the components in FIG. 10. In this case, too, when the charge voltage of the main condenser C rises and the voltage of the condenser C reaches the Zener voltage of the Zener diode TD, the Zener diode TD will conduct, a Zener current will flow, turning transistor Q on. Its signal will be inverted by the invertor I, the CHRG signal changes to the "H" level and the charging operation is stopped.

Further, a voltage sensing means in which the voltage of a main condenser is divided by resistances without using a voltage sensitive device and is judged by a voltage sensing circuit, is known by the Japanese Patent Application Laid Open No. 193131/1990. In this circuit, as shown in FIG. 12, the charge voltage of the main condenser C is divided by resistances $R_4$ and $R_5$ and their values are judged by comparators $CP_1$ and $CP_2$ so that, when the divided voltage is lower than a preset voltage, to be more fully described, it will be judged that the voltage of the main condenser has not reached the used voltage and a DC/DC converter CO continues to operate but, in a case they become equal to a set voltage, the operation of the DC/DC converter is stopped and the charge to the main condenser is stopped.

Now, in a camera with a strobe built-in, there is adopted a means whereby, when the charge voltage to the main condenser of the strobe is below a full charge voltage sufficient to flash a xenon lamp, such as a flashing discharge tube, or is below a charge voltage lower by several steps than a proper exposure value, release of a shutter will be locked to prevent making a photograph due to a large exposure shortage.

Now, in the above mentioned conventional voltage sensing circuit using a voltage sensing device such as a neon lamp or Zener diode, there is only one voltage detecting level. The charge stopping voltage and the flash permitting voltage must be set at the same value so that, when the release button is pushed, unless the charge stopping voltage is reached, that is, unless a full charge is reached, operation of the flash will not be permitted. Therefore, even if, below a full charge, a charge voltage at which a flash photographing can be made is reached, during the strobe charging, no release will be made and, in the case of a continuous photographing, when a full charge is reached, release will be made. Therefore, there are defects that the continuous photographing time will become long and a shutter chance will be missed.

In the conventional voltage sensing circuit shown in the above mentioned FIG. 12, when the set voltages $Vref_1$ and $Vref_2$ of the comparators $CP_1$ and $CP_2$ are made different from each other, the charge stopping voltage and flash permitting voltage are separately sensed/but there are defects in that a separate voltage judging circuit is required, the fitting space increases and the cost of the camera also increases.

OBJECTS OF THE INVENTION

A main object of the present invention is to provide an electronic flashing device wherein the above mentioned conventional defects are eliminated and the charge stopping voltage and flash permitting voltage can be separately sensed.

Another object of the present invention is to provide an electronic flashing device wherein a charge stopping voltage and flash permitting voltage can be separately sensed and a more accurate detecting voltage is thus obtained.

Further, another object of the present invention is to provide an electronic flashing device wherein a plurality of signals output from a charge voltage sensing circuit detecting the charge voltage state of the main condenser are output by one signal line.

Briefly the invention provides a power source boosting circuit receiving a boosting controlling signal for boosting the power source voltage, a main condenser charged with the boosted voltage of the power source boosting circuit, a series circuit connected in parallel with the main condenser and consisting of a pass condenser and voltage sensing device and a voltage dividing circuit applying a divided voltage of the charge voltage of the main condenser to a connecting point between the pass condenser and voltage sensing device and a diode connected between the connecting point of the above mentioned condenser and voltage sensing device and the above mentioned voltage dividing circuit.

The objects and advantages of this invention will become more apparent from the following detailed explanation.

DETAILED DESCRIPTION OF THE INVENTION AND PREFERRED EMBODIMENTS THEREOF

Figure 1:
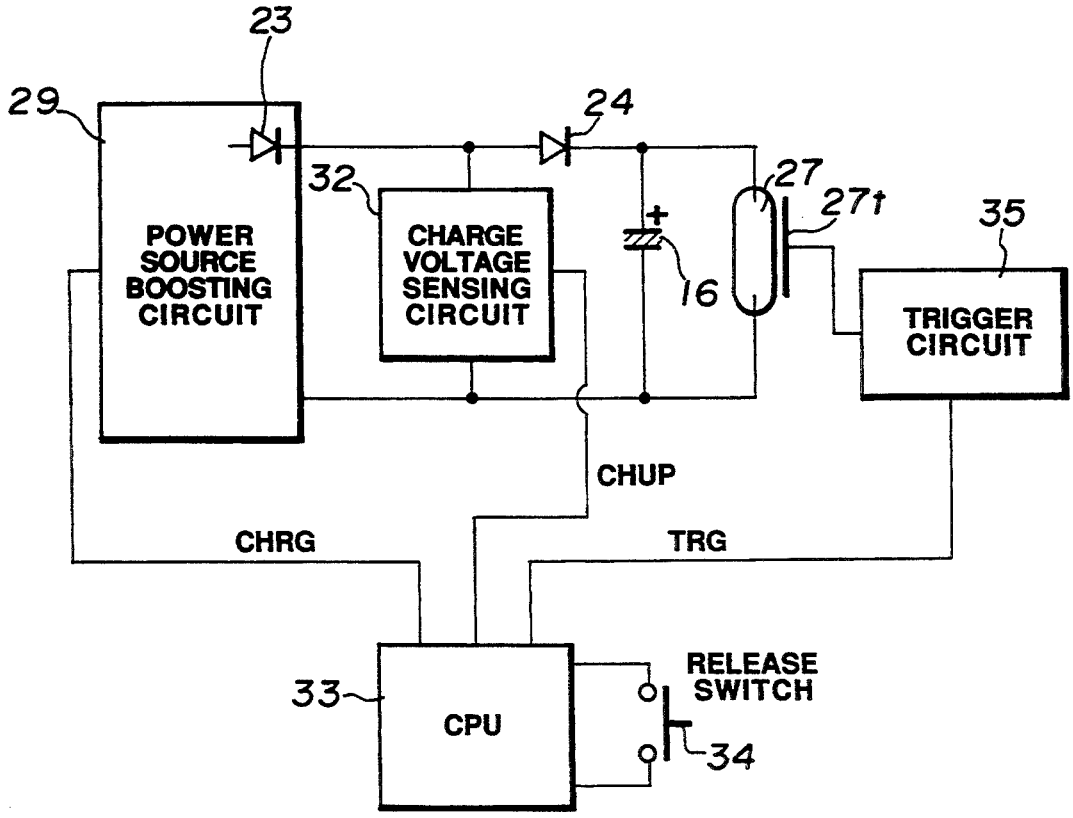
FIG. 1 is a formation block diagram showing the scheme of an electronic flashing device of a first embodiment of the present invention.

First of all, the scheme of the electronic flashing device of the first embodiment of the present invention shall be explained with reference to FIG. 1. When a charge starting signal which is a CHRG signal is input into a power source boosting circuit 29 from a CPU 33, circuit 29 applies a boosted voltage to a main condenser 16 through a rectifying diode 23 and reverse current preventing diode 24, charging the main condenser. When the voltage of the main condenser reaches a predetermined voltage level, a charge voltage sensing circuit 32 consisting of a series circuit of a pass condenser and voltage sensing device and a voltage dividing circuit obtaining a divided voltage of the charge voltage of condenser 16, provides a charge up signal (referred to as a CHUP signal hereinafter) which signal is coupled to CPU 33 such as a micro-processor causing the CPU to stop applying the charge starting signal CHRG to the power source boosting circuit 29.

When boosting circuit 29 is operated, and the charge voltage of condenser 16 is higher than a charge completion voltage (charge stopping voltage), charge voltage sensing circuit 32 outputs a first signal of a first level, when the charge voltage of the above mentioned main condenser is lower than a flash possible voltage, the charge voltage sensing circuit outputs a second signal of a second level and, when the charge voltage of main condenser 16 is higher than the flash possible voltage but is lower than the charge completion voltage, the charge voltage sensing circuit outputs a third signal which comprises a pulse-like signal which makes a transition between the first signal and the second signal.

When the release switch 34 is pushed, CPU 33 outputs to boosting circuit 29 a CHRG signal which is a short charge starting signal and thereafter it is checked whether a CHUP signal is output from the charge voltage sensing circuit 32 or not. If it is output, the release will be permitted, a trigger signal (mentioned as a TRG signal hereinafter) will be output to a trigger circuit 35 and flashing discharge tube 27 is excited by a trigger electrode 27*t* and flashes.

Figure 2:
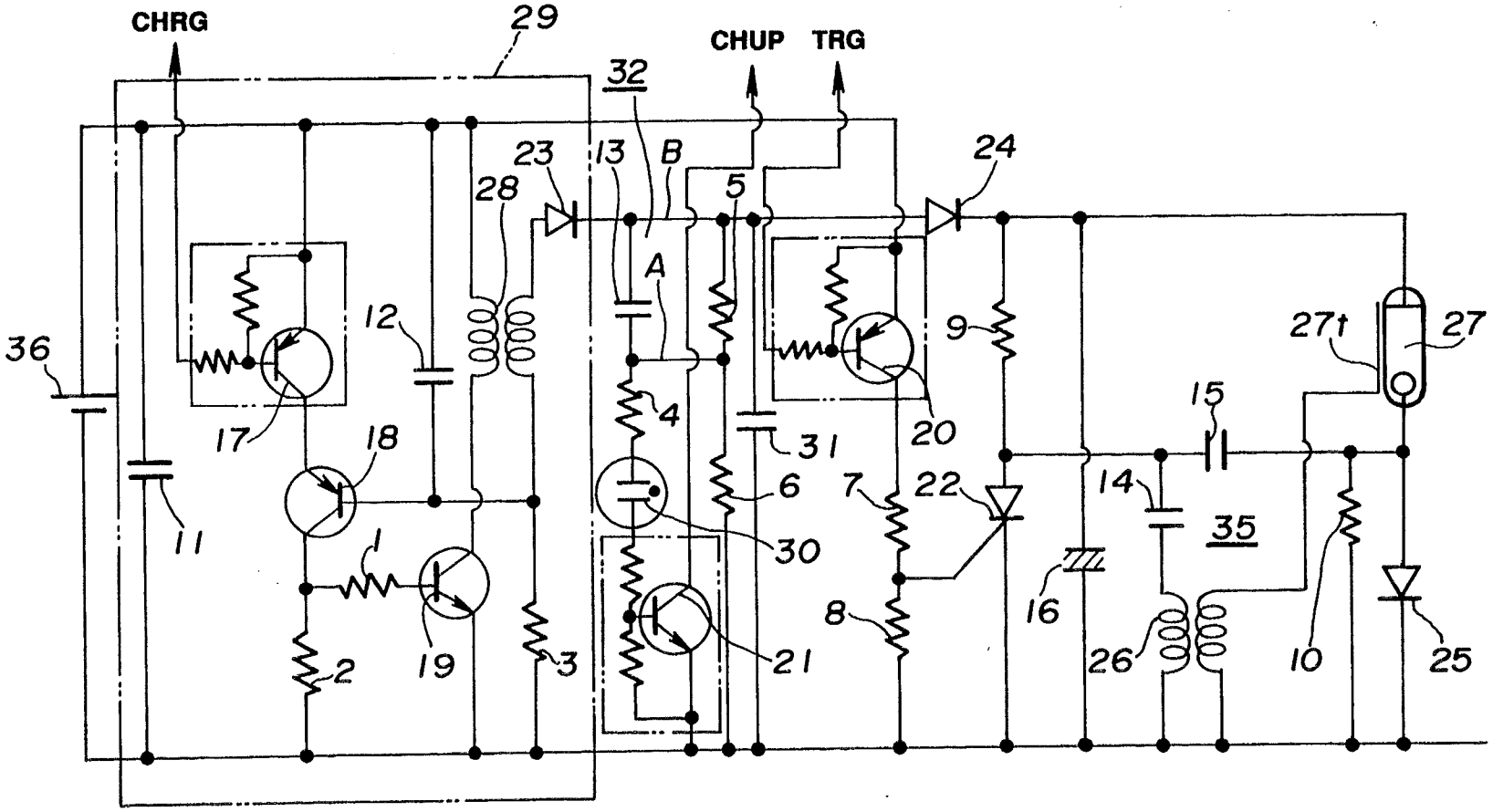
FIG. 2 is an electric circuit diagram of an electronic flashing device showing the first embodiment of the present invention in greater detail.

FIG. 2 is an electric circuit diagram of an electronic flashing device showing the details of the first embodiment of the present invention. The power source boosting circuit 29 for boosting the voltage of a power source battery 36 comprises resistances 1, 2 and 3, condensers 11 and 12, transistors 17, 18 and 19, a boosting transformer 28 and rectifying diode 23, which electrical components are connected as illustrated. A charge starting signal CHRG is applied to transistor 17 from a CPU (not illustrated). Rectifying diode 23 connects the output of power source boosting circuit 29 respectively to the charge voltage sensing circuit 32, main condenser 16, flashing discharge tube 27, consisting of an Xe discharge tube, and trigger circuit 35.

Trigger circuit 35 includes a series circuit consisting of a transistor 20 and resistances 7 and 8, a series circuit consisting of a resistance 9 and flash starting thyristor 22, a trigger condenser 14 and trigger transformer 26 and operates when a TRG signal is applied to a base electrode of transistor 20 to apply a high pulse voltage to a trigger electrode 27*t*. Flashing discharge tube 27 is connected to a diode 25, a voltage multiplying resistance 10 and condenser 15.

The charge voltage sensing circuit 32 is formed of a voltage dividing circuit consisting of a series circuit of resistances 5 and 6, a series circuit consisting of a pass condenser 13, resistance 4, neon lamp 30 and transistor 21 and a ripple absorbing condenser 31. The connecting point between resistances 5 and 6 is connected to the connecting point between pass condenser 13 and resistance 4. The resistances 5 and 6 are voltage dividing resistances for dividing the voltage of the main condenser 16 and their resistance value is set so that, when the charge voltage of main condenser 16 reaches the charge stopping voltage, the voltage divided by the resistances 5 and 6 will be equal to the lighting voltage of the neon lamp. The neon lamp 30 will light when a predetermined voltage is applied to it. Its lighting voltage is set at the flash permitting voltage of the strobe. The pass condenser 13 has a role of passing the current flowing through resistance 5.

The operation of the electronic flashing circuit of the first embodiment shall now be described.

(1) Charge and Charge Stopping Operation

Figure 3:
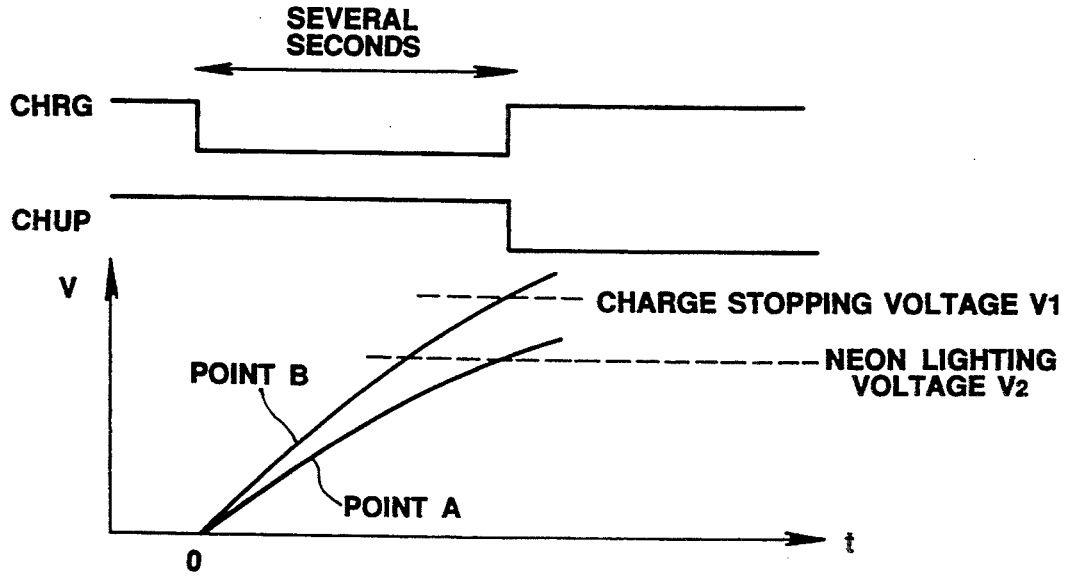
FIG. 3 and 4 are timing charts for explaining the operation of the electronic flashing device of the first embodiment.

First of all, in the charging operation, the DC/DC converter, i.e. power source boosting circuit 29, is started by charge starting signal CHRG issued from a CPU and the main condenser 16 is charged. In this state, the voltage of the main condenser 16 is divided by resistances 5 and 6 and this divided voltage is applied to neon lamp 30. In the charge stopping operation, when the voltage of the main condenser 16 rises and the divided voltage reaches the lighting voltage $V_2$ of the neon lamp 30, which voltage is set to be lower than the charge stopping voltage $V_1$ (see FIG. 3), the neon lamp 30 will light, transistor 21 is switched on by the lighting current through lamp 30, and the CHUP signal will be at the "L" level and, receiving this signal, the CPU switches off the CHRG signal. This operation is shown in FIG. 3. That is to say, FIG. 3 shows an ordinary charging operation and charge stopping operation and shows respectively the voltage curves of the points A and B in the charge voltage sensing circuit 32 in FIG. 2. The voltage curve of the voltage at point A and the voltage curve of the voltage at point B (see FIG. 2) can be easily set by the ratio of the constants of the resistances 5 and 6 of the voltage dividing circuit.

(2) Flash Permitting Voltage Sensing Operation

In this flash permitting voltage sensing operation, if the charge stopping voltage is represented by $V_1$, the flash permitting voltage (=neon lighting voltage) is represented by $V_2$, the main condenser voltage is represented by $V_{mc}$ and the neon extinguishing voltage is represented by $V_3$. When the main condenser voltage is $V_2 \leqq V_{mc} < V_1$, and the release button is pushed, the CPU will operate the power source boosting circuit 29 for a period of several ms to several 10 ms to check the voltage of the main condenser 16 and then a voltage substantially equal to the main condenser voltage $V_{mc}$ will be generated between the diodes 23 and 24. The moment this voltage is generated, as no charge is accumulated in pass condenser 13, the same voltage as the main condenser voltage $V_{mc}$ will be generated at point A and, as $V_2 \leqq V_{mc}$, the neon lamp 30 will light.

After the neon lamp lights, by the neon lighting current and the current flowing through the resistance 6, the voltage across pass condenser 13 rises with the lapse of time. If this voltage is represented by $V_c$, the voltage applied to the neon lamp 30 will be $V_{mc}-V_c$ and, when $(V_{mc}-V_c) \leqq$ neon extinguishing voltage $V_3$, the neon lamp 30 will be extinguished.

Summarizing the above operation, when $V_2 \leqq V_{mc} < V_1$, if power source boosting circuit 29 is started, neon lamp 30 will light only for a short time which will vary with the voltage hysteresis of the pass condenser 13, resistance 6 and lighting and extinguishing of the neon lamp 30 but will be a time of approximately several ms and this lighting will become a short pulse signal which will be output as a CHUP signal.

Then, when $V_2 \leqq V_{mc}$, in the same manner, the moment the voltage source boosting circuit 29 is started, $V_{mc}$ will be applied to the neon lamp 30 but, as $V_2 > V_{mc}$, the neon lamp will not light.

When $V_1 \leqq V_{mc}$, the moment the power source boosting circuit 29 is started, the neon lamp 30 will light and, even if the voltage across the pass condenser 13 is elevated, as the voltage divided by the resistances 5 and 6 is higher than the lighting voltage of the neon lamp, the neon lamp will remain lit.

Therefore, the CPU judges the main condenser voltage to be lower than the flash permitting voltage $V_2$ when the pulse of the CHUP signal is not output (i.e. CHUP is at a high level), to be higher than the flash permitting voltage $V_2$ but lower than the charge stopping voltage $V_1$ when a short pulse is output and to be higher than the charge stopping voltage $V_1$ when a continuous CHUP signal is output (i.e. a low level or ground potential).

Figure 4:
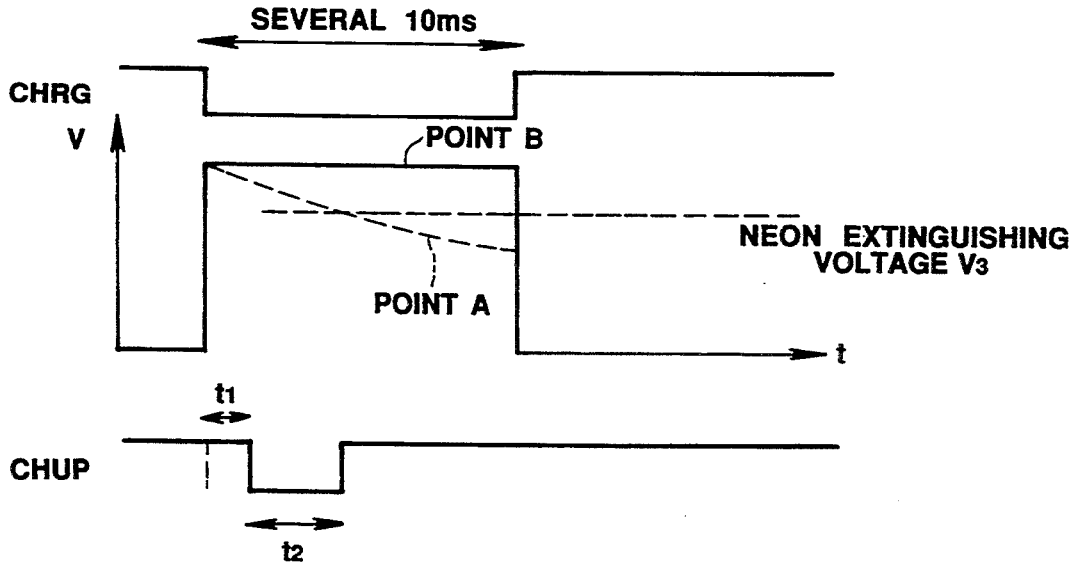

This operation is shown in FIG. 4 in which $t_1$ represents a neon lighting delay time and $t_2$ represents a time during which neon lamp 30 lights. That is to say, when the neon lamp remains lit, the CPU will judge the charge to be completed and will stop charging the main condenser. When the lamp lights for a short time, the CPU will permit operation of the flash, that is, the release and will accept pushing down of the release button. When the neon lamp does not light, the CPU will judge flashing to be impossible, that is, to be non-permissible and will not accept the release.

Figure 12:
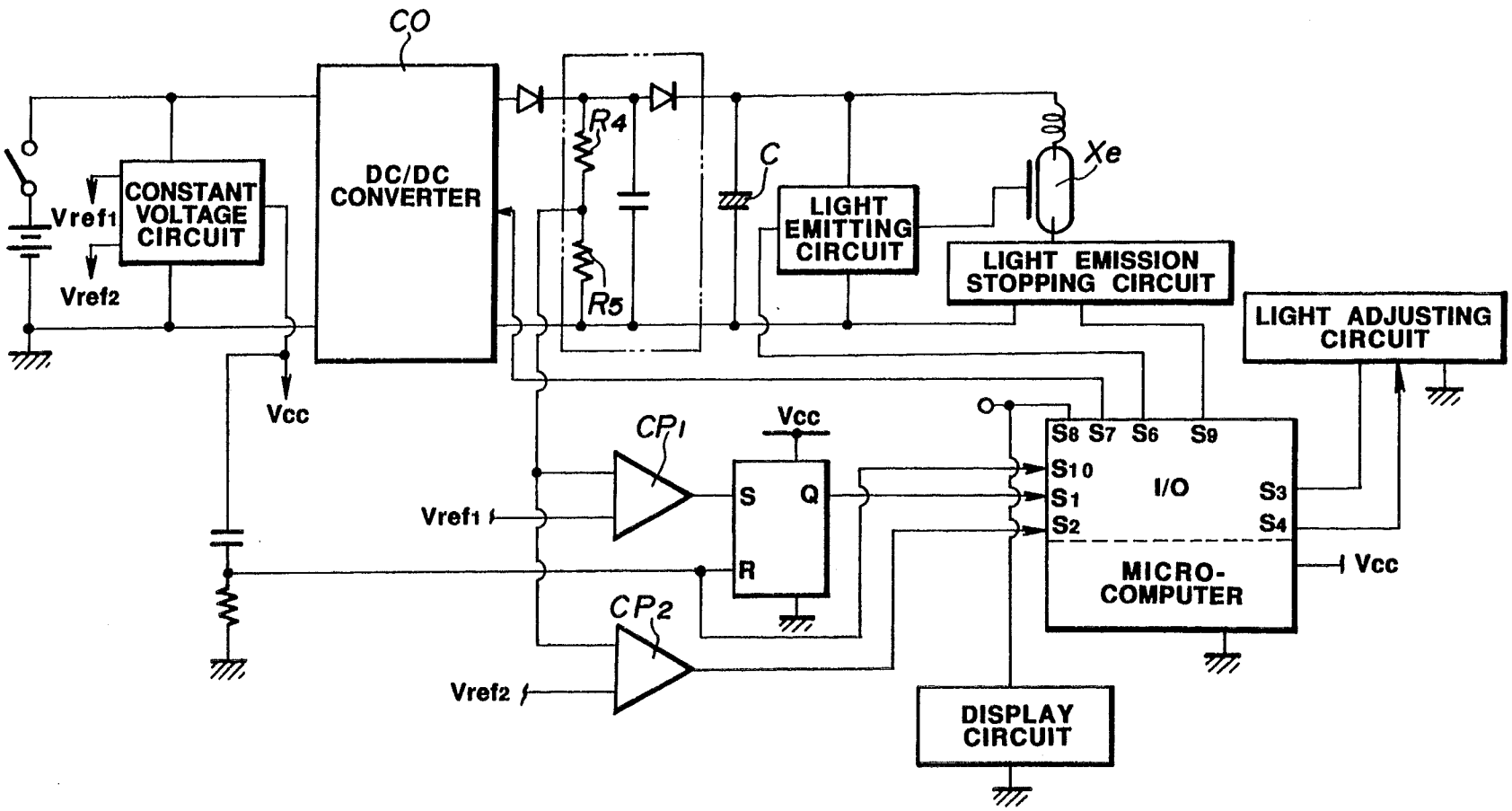
FIG.12 (PRIOR ART)
FIG. 12 is an electrical circuit diagram showing still another example of a conventional electronic flashing circuit.

These three states of the main condenser charge voltage can be judged by examining a single line transmitting the CHUP signal. That is to say, on the basis of the signal from this one line, the CPU of the camera can control the charge continuation and stop, release permission and non-permission, displaying them within the finder and the like, coupled to the CPU such as by a display device as shown in FIG. 12.

Figure 5:
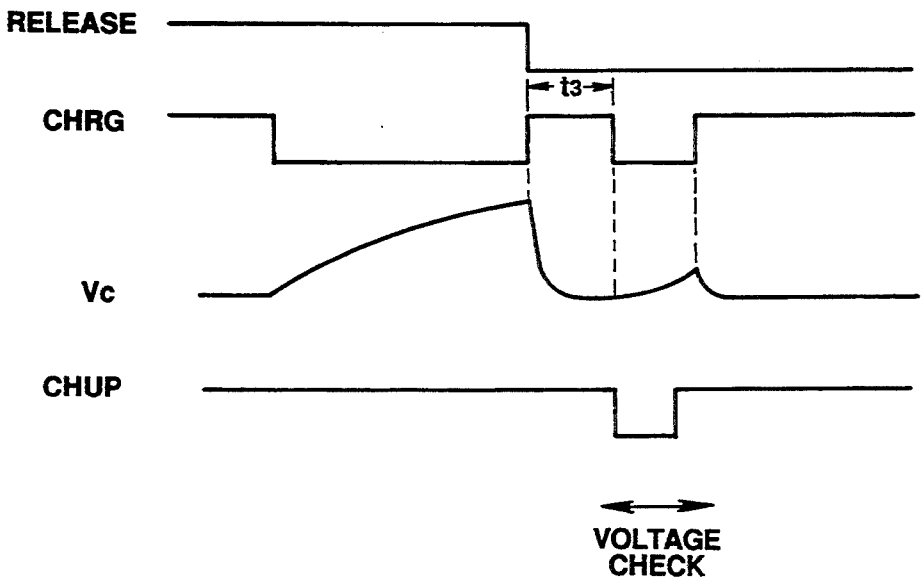
FIG. 5 is a timing chart for explaining the operation when a release button is pushed during charging in the electronic .flashing device of the first embodiment.

A case when a release button is pushed while the strobe is being charged shall be explained. While the strobe is being charged, the pass condenser 13 is charged to a voltage $V_c$ equal to the voltage across resistance 5. Therefore, when the charge voltage is checked, the voltage applied to the neon lamp 30 will be reduced by the voltage $V_c$. Therefore, when the release button is pushed while the strobe is being charged, as shown in FIG. 5, charging is initially stopped for a time $t_3$ and then the charge of the pass condenser 13 is discharged through the resistance 5. After the voltage $V_c$ is made zero volts, and if the voltage is checked by starting a charging operation, the voltages of the points A and B will be equal to each other ($V_c=0$) and the voltage applied to the neon lamp 30 is not reduced by a voltage $V_c$ while the strobe is being charged. This operation is shown in FIG. 5.

The above is an explanation of the operation of the first embodiment. The condenser 31 inserted between ground at point B to absorb ripples can also make the diode 24 unnecessary by using a so-called slow recovery diode which has a long reverse recovery time.

Thus, according to the first embodiment, as a voltage of two levels can be detected with a voltage detecting device consisting of one neon lamp, when the release button is pushed, even when the voltage is lower than the charge stopping voltage, a flash permission will be output and therefore there will be obtained effects that the shutter chance will not be missed and continuous photographing will be quick.

Figure 6:
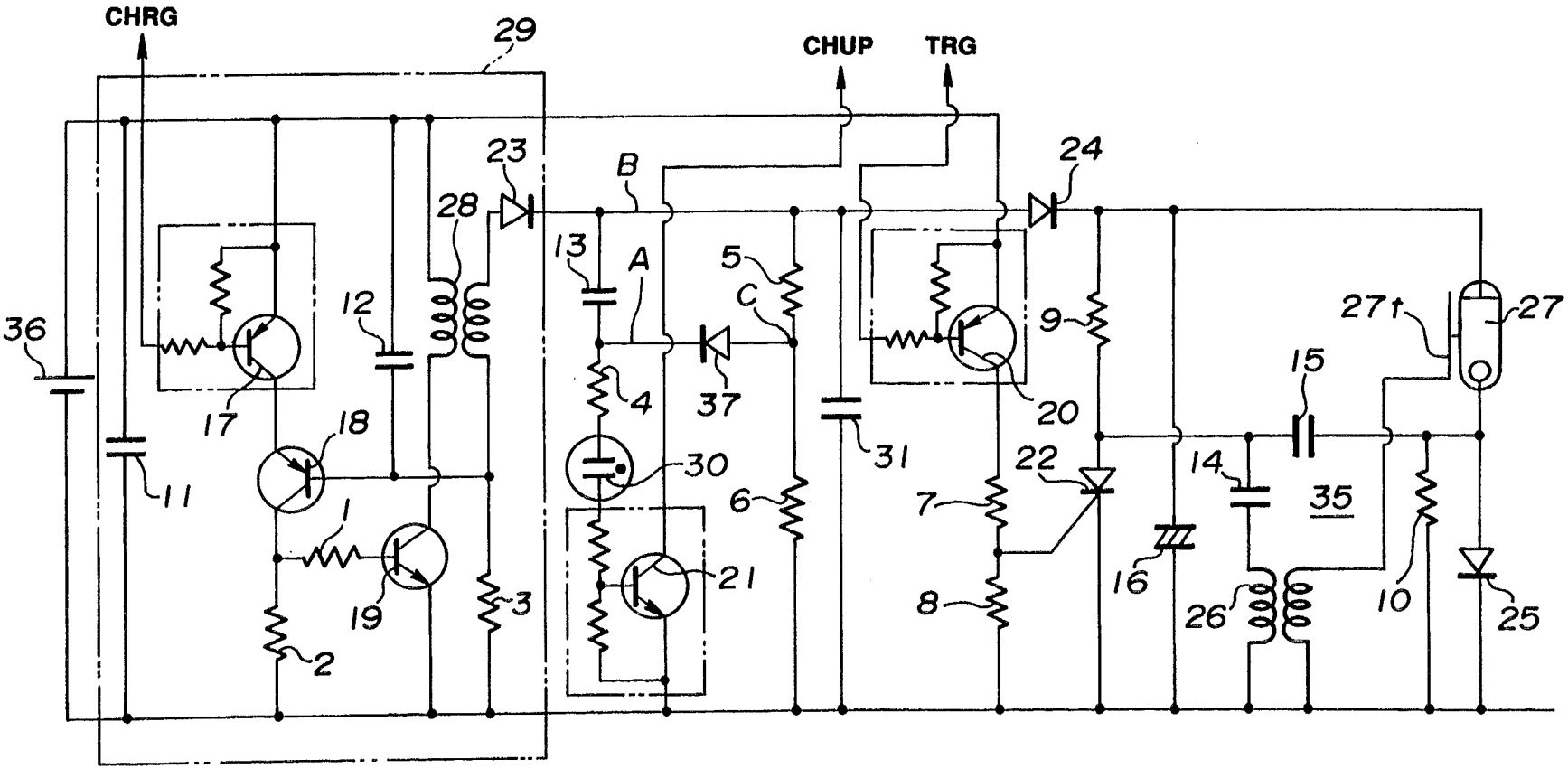
FIG. 6 is an electrical circuit diagram of an electronic flashing device showing a second embodiment of the present invention.

The second embodiment of the present invention shall be explained in the following with reference to FIG. 6. In the formation of a flashing circuit of this second embodiment, a diode 37 is added to the flashing circuit of the first embodiment. That is to say, as shown in FIG. 6, diode 37 prevents current from flowing from pass condenser 13 toward the resistance 6 and is connected between the connecting point of the resistances 5 and 6 and the connecting point between pass condenser 13 and resistance 4.

(3) Charge and Charge Stopping Operation

In the charging operation in this second embodiment, when, a CHRG signal is provided from the CPU, the DC/DC converter, that is, power source boosting circuit 29, is started and main condenser 16 starts to charge, substantially the same voltage as the voltage $V_{mc}$ of the main condenser 16 will be generated at point B. At this time, the voltage $V_c$ across the pass condenser 13 is zero volts, because the current is prevented by the diode 37 from flowing from pass condenser 13 toward the resistance 6.

Figure 7:
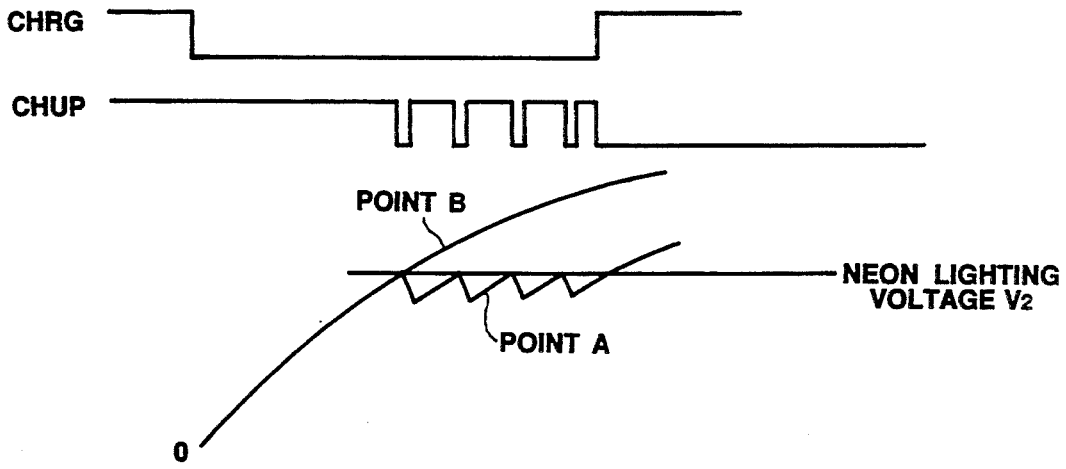
FIG. 7 and 8 are timing charts for explaining the operation of the electronic flashing device of the second embodiment.

Therefore, the main condenser voltage $V_{mc}$ equal to that at the point B is applied to point A. The charge stopping operation will be as shown in FIG. 7. That is to say, when charging is continued and the neon lighting voltage $V_2$=main condenser voltage $V_{mc}$, the neon lamp will light, and then pass condenser 13 will be charged with the neon lighting current and the voltage at the point A will become $V_{mc}-V_c$. Therefore, when this voltage is lower than the neon extinguishing voltage, neon lamp 30 is extinguished: When the neon lamp is extinguished, the voltage for the hysteresis of the neon lamp will naturally remain in the pass condenser but thereafter, when the main condenser voltage $V_{mc}$ rises and the voltage at the point A reaches the neon lighting voltage, the neon lamp 30 will light, the pass condenser 13 will be charged and the neon lamp 30 will be extinguished. While this is being repeated, the main condenser voltage $V_{mc}$ will rise. When the connecting point C of the resistances 5 and 6 reaches the neon lighting voltage, the neon lamp 30 will light, and thereafter the neon lighting current will be fed from the resistance 5 side and therefore the neon lamp 30 will remain lit. Therefore, at this time, the charge will be stopped.

(4) Flash Permitting Voltage Sensing Operation

This flash permitting voltage sensing operation is the same as the first embodiment and therefore shall not be explained here.

Figure 8:
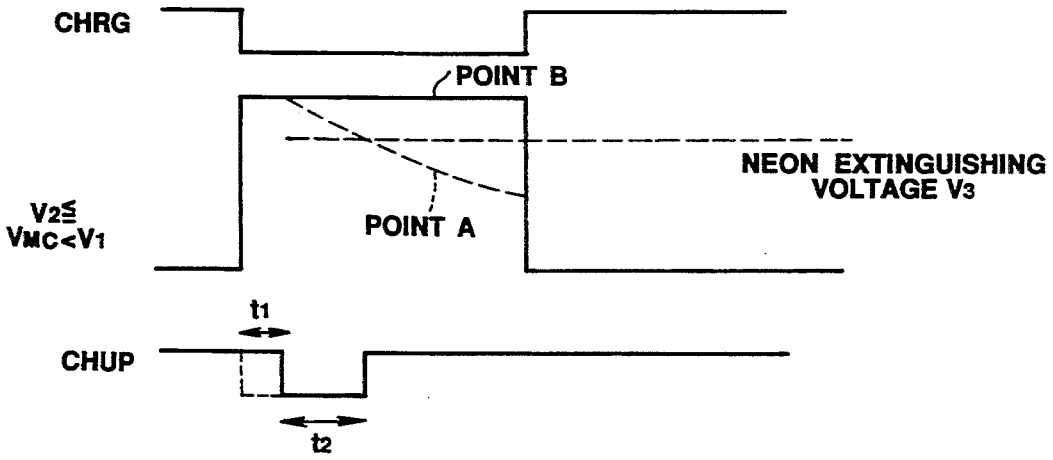
Figure 9:
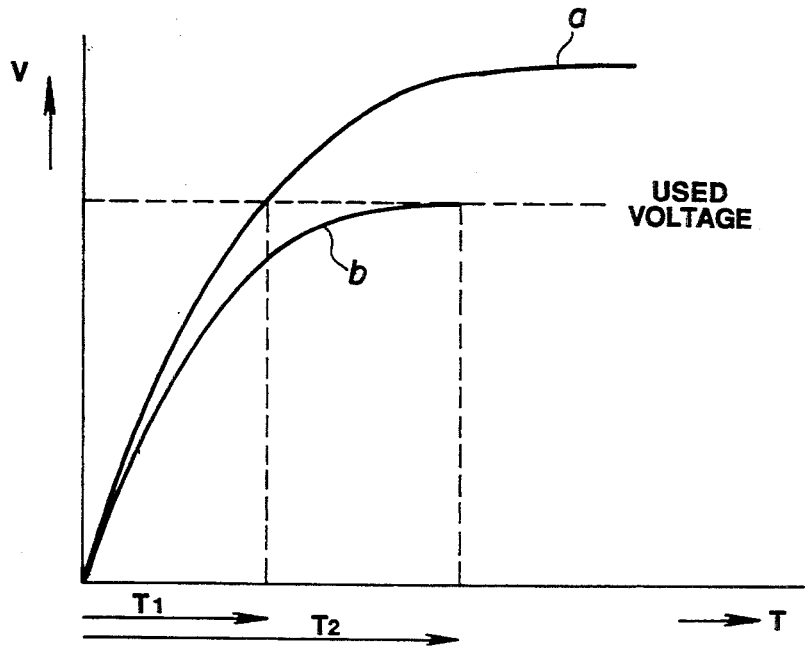
FIG. 9 is a diagram showing charging curves of the main condenser for different output voltages of a boosting transformer.
Figure 10:
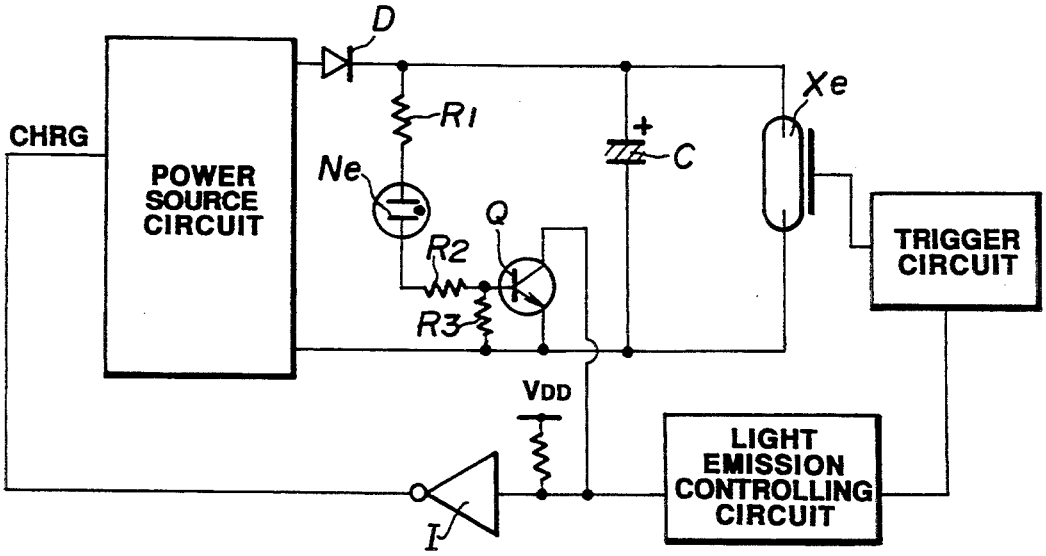
FIG. 10 (PRIOR ART)
FIG. 10 is an electrical circuit diagram showing an example of a conventional electronic flashing circuit.
Figure 11:
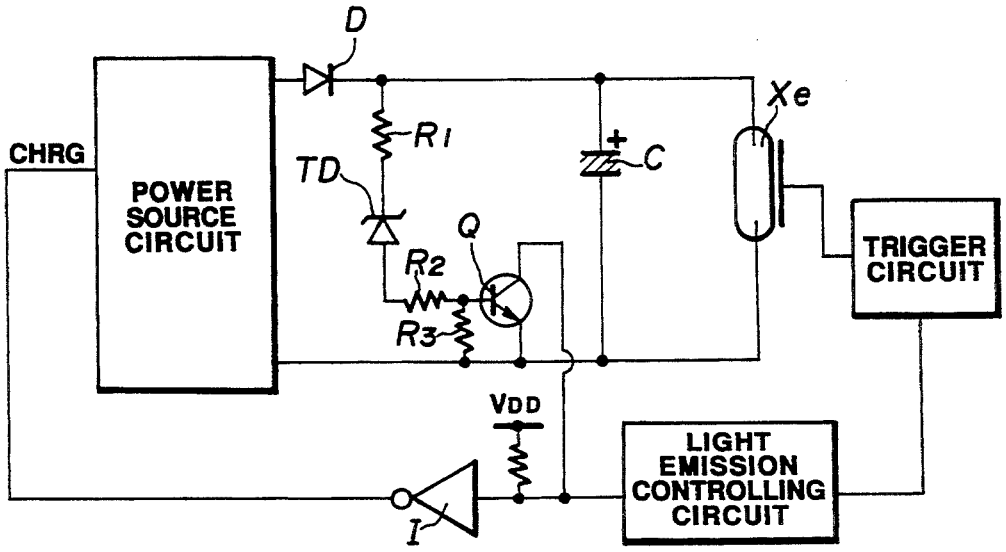
FIG. 11 (PRIOR ART)
FIG. 11 is an electrical circuit diagram showing another example of a conventional electronic flashing circuit.

However, the waveforms of the respective parts are a little different and therefore shall be shown in FIG. 8. The difference from the first embodiment is that, when the voltage is checked, the voltage at the point A will not lower except after the neon lamp is lit. In the first embodiment, the voltage begins to lower as soon as the CHRG signal is switched on, and the voltage lowering during the neon lamp lighting delay time $t_1$ will become a detected voltage error. In order to make this error small, it is necessary to make the constant of the pass condenser 13 large but, in this second embodiment, even during the neon lamp lighting delay, the voltage at the point A will not lower and therefore a comparatively small condenser will do.

Now, the voltage check during the charge of the strobe is also the same as in the first embodiment. However, the time when the CHRG signal is off may be short by the small constant of the pass condenser 13. By the way, the judgment of the CPU is the same as in the first embodiment.

According to this second embodiment, the detected voltage becomes more accurate, the capacity of the pass condenser 13 can be made small and the cost and space can be reduced.

What is claimed is:

1. An electronic flashing device comprising:

a boosting circuit for boosting a power source voltage;

a main condenser charged by said boosting circuit;

a flashing discharge tube for discharging the charge with which said main condenser is charged;

a trigger circuit for exciting said flashing discharge tube;

a charge voltage sensing circuit connected to said boosting circuit and said main condenser, said charge voltage sensing circuit having at least two voltage dividing resistances connected in series, a pass condenser connected in parallel with one of said resistances, and a series circuit consisting of a voltage sensing device for sensing a charge voltage of said main condenser and a switching device connected in parallel with the other of said resistances; and a micro-processor for transmitting a boosting signal for a given period enabling said boosting circuit to carry out a boosting operation, said micro-processor including means for receiving a signal from said switching device of said charge voltage sensing circuit and judging a charge state of said main condenser, said micro-processor judging a charge voltage of said main condenser to be a voltage higher than a charge completion voltage when said switching device signal is at a first signal level during the period of said boosting operation, judging a charge voltage of said main condenser to be a voltage lower than a flash possible voltage when said switching device signal is at a second signal level different from said first signal level during the period of said boosting operation and judging a charge voltage of said main condenser to be a voltage higher than said flash possible voltage but lower than said charge completion voltage when said switching device signal is a pulse which makes a transition between the first signal level and the second signal level during the period of said boosting operation.

2. An electronic flashing device according to claim 1 wherein:

in the series circuit of said charge voltage sensing circuit consisting of said voltage sensing device and switching device, said switching device having a controlling terminal and two main electrodes, the controlling terminal of said switching device and said voltage sensing device being connected in series and one of the main electrodes of said switching device being connected to said micro-processor means for receiving said switching device signal; and wherein said switching device generates a pulse which makes a transition between the first state and the second state signal only when a charge voltage of said main condenser is higher than the flash possible voltage but is lower than the charge completion voltage during a charging time of said pass condenser, and wherein said switching device thereafter generates said first signal state when said charge voltage is higher than the charge completion voltage.

3. An electronic flashing device according to claim 1 characterized in that:

said charge voltage sensing circuit further includes a diode connected between a connecting point of said voltage dividing resistances and a connecting point of said pass condenser and said series circuit consisting of said voltage sensing device and said switching device.

4. An electronic flashing device according to claim 1 characterized in that:

said voltage sensing device conducts when a voltage applied to the voltage sensing device exceeds said flash possible voltage and said one resistance and said other resistance are of a resistance ratio in which said flash possible voltage will be applied to said voltage sensing device when said main condenser reaches the charge completion voltage.

5. An electronic flashing device comprising:

a power source boosting circuit for boosting a voltage of a power source battery;

a main condenser charged by said power source boosting circuit;

a charge voltage sensing circuit connected to said power source boosting circuit and said main condenser, said charge voltage sensing circuit having at least two voltage dividing resistances connected in series, a pass condenser connected in parallel with one of said resistances and a series circuit consisting of a voltage sensing device and a switching device connected to said pass condenser at one end and connected in parallel with another one of said resistances, said pass condenser being coupled between said main condenser and said voltage sensing device;

a flash discharging tube connected in parallel with said main condenser;

a trigger circuit for exciting said flashing discharge tube; and a micro-processor for outputting a boosting controlling signal for a given period enabling said power source boosting circuit to start a boosting operation, said micro-processor including means for detecting a state of said switching device at a single output thereof over said given period and thereby detecting one of three charge conditions of said main condenser determined by one of three different signal occurring during the given period of the boosting operation including a first state, a second state different from said first state and a pulse which makes a transition between said first state and said second state to permit operation of the trigger circuit when detecting two of the three signal states and to prevent operation of the trigger circuit when detecting a remaining one of said three possible signal states.

6. An electronic flashing device according to claim 5 wherein:

in the series circuit of said charge voltage sensing circuit, said switching device has a controlling terminal and a pair of main electrodes, the controlling terminal of said switching device and said voltage sensing device being connected in series and one of the main electrodes of said switching device being connected to said micro-processor means for detecting so that, when a voltage at the connection of said voltage sensing device and pass condenser exceeds a predetermined potential, said switching device is turned on.

7. An electronic flashing device according to claim 5 wherein:

said voltage sensing device includes a neon tube.

8. An electronic flashing device according to claim 5 wherein:

said voltage sensing device includes a Zener diode.

9. An electronic flashing device according to claim 5 characterized in that:

said charge voltage sensing circuit further includes a diode coupled between the connecting point of said voltage dividing resistances and the connecting point of said pass condenser and series circuit.

10. An electronic flashing device according to claim 5 characterized in that:

said voltage sensing device conducts when a voltage applied to said voltage sensing device exceeds a flash possible voltage of a charge voltage of said main condenser and said voltage dividing resistances provide a resistance ratio to apply said flash possible voltage to said voltage sensing device when said main condenser reaches the charge completion voltage.

11. An electronic flashing device comprising:

a boosting circuit for boosting a power source voltage;

a main condenser charged by said boosting circuit;

a flashing discharge tube for discharging a charge with which said main condenser is charged;

means for operating said boosting circuit for a given period;

a charge voltage sensing circuit connected in parallel with said main condenser, said charge voltage sensing circuit having an output at a first state when a charge voltage of said main condenser is a voltage higher than a charge completion voltage during a period when said boosting circuit is operated, having a second state different from said first state when a charge voltage of said main condenser is a voltage lower than a flash possible voltage, and generating a pulse which makes a transition between the first state and second state when a charge voltage of said main condenser is a voltage higher than said flash possible voltage and lower than said charge completion voltage, said first, second and third states being conveyed over a single signal line; and a controlling means coupled to said single signal line for receiving said signals from said charge voltage sensing circuit for use in judging a charge condition of said main condenser.

12. An electronic flashing device according to claim 11 wherein:

said charge voltage sensing circuit has at least two voltage dividing resistances connected in series, a pass condenser connected in parallel with one of said resistances and a series circuit comprising a voltage sensing device and switching device and connected to one end of said pass condenser and connected in parallel with another one of said resistances and said first and second states and said transition are output from said switching device.

13. An electronic flashing device comprising:

a boosting circuit for boosting a voltage of a power source battery in response to a boosting controlling signal and outputting an output of the boosting circuit through a first diode;

a main condenser series circuit comprising a second diode and main condenser, said first and second diodes connecting the main condenser to said boosting circuit;

a discharge tube connected to said main condenser;

a trigger circuit for exciting said discharge tube in response to a trigger signal;

a controlling means for selectively outputting a booster controlling signal to said boosting circuit and a trigger signal to said trigger circuit;

a main condenser charge voltage detecting circuit connected to said main condenser series circuit for outputting a detecting signal in response to a charge voltage of the main condenser, said detecting circuit being formed of a second series circuit comprised of a pass condenser, a voltage detecting device and a switching device, a voltage dividing circuit comprising two resistances and connected in parallel with said second series circuit, a connecting point between the pass condenser and voltage detecting device of said series circuit and a connecting point between the two resistances of said voltage dividing circuit being connected with each other, said pass condenser having a first terminal connected between said second diode and said main condenser and a second terminal connected to said voltage detecting device.

14. An electronic flashing device according to claim 13 wherein:

said voltage detecting device is set to output a detecting signal when a flash possible voltage corresponding to a lowest voltage required for said trigger circuit to excite the discharge tube is applied to said voltage detecting device and a voltage dividing ratio of said voltage dividing circuit is set so that a divided voltage applied to said voltage detecting device will be said flash possible voltage when a charge voltage of said main condenser reaches a charge completion voltage.

15. An electronic flashing device according to claim 13 wherein:

in the voltage detecting device of the charge voltage detecting circuit of said main condenser, in an initial period of starting a boosting operation of said boosting circuit, a charge voltage of said main condenser is applied to said voltage detecting device and thereafter a divided voltage of the main condenser will be applied to said charge voltage detecting circuit by said voltage dividing circuit.

16. An electronic flashing device according to claim 13 wherein:

after a boosting operation of said boosting circuit is started and within a predetermined time, when a charge voltage of said main condenser is higher than a charge completion voltage, the output of the charge voltage detecting circuit will be at a first output level, when a charge voltage is lower than a flash possible voltage, the output will be at a second output level different from said first output level and further, when a charge voltage is lower than the charge completion voltage but is higher than the flash possible voltage, the output will be a pulse which makes a transition between said first and second output levels.

17. An electronic flashing device according to claim 13 wherein:

said connecting point of said voltage dividing circuit and said connecting point of said series circuit are connected with each other through a diode.

18. An electronic flashing device comprising:

a boosting circuit for boosting a voltage of a power source battery in response to a boosting controlling signal;

a main condenser series circuit comprising a diode and main condenser being connected to said boosting circuit;

a discharge tube connected to said main condenser;

a trigger circuit for exciting said discharge tube in response to a trigger signal;

release means for generating a release signal to initiate a photographing operation;

a detection initiation signal outputting means outputting a detection initiation signal responsive to a release signal for initiating a detection of a charge voltage of said main condenser;

a main condenser charge voltage detecting circuit connected to said main condenser series circuit, said detecting circuit being formed of a second series circuit consisting of a pass condenser and voltage detecting device, a voltage dividing circuit comprising two resistances, said voltage dividing circuit being connected in parallel with said second series circuit, a connecting point between the pass condenser and voltage detecting device of said second series circuit and a connecting point between the two resistances of said voltage dividing circuit being connected with each other, said detecting circuit further including means for outputting a given detecting signal state when a voltage higher than a predetermined voltage is applied to said voltage detecting device;

a controlling means outputting a boosting controlling signal to said boosting circuit and a trigger signal to said trigger circuit, said controlling means outputting a boosting controlling signal for a predetermined time when a detection initiation signal is output from said detection initiation signal outputting means; and a judging means for judging a state of a charge voltage of the main condenser in response to an output from the charge voltage detecting circuit of said main condenser.

19. An electronic flashing device according to claim 18 wherein:

said predetermined voltage of said voltage detecting device is set at a flash possible voltage corresponding to a lowest voltage required for the trigger circuit to excite the discharge tube and a voltage dividing ratio of said voltage dividing circuit is set so that, when a charge voltage of said main condenser reaches a charge completion voltage, a divided voltage applied to said voltage detecting device will be at least as great as said flash possible voltage.

20. An electronic flashing device according to claim 18 wherein:

the voltage detecting device of the charge voltage detecting circuit of said main condenser operates so that, in an initial period of starting a boosting operation of said boosting circuit, a charge voltage of said main condenser is applied to said voltage detecting device and thereafter a divided voltage of the main condenser will be applied to the voltage detecting device so that, after a boosting operation of said boosting circuit is started, and within a predetermined time, the charge voltage detecting circuit of the main condenser:

continuously outputs a first level when a charge voltage of said main condenser is higher than a charge completion voltage; outputs a second level when a charge voltage is lower than a flash possible voltage; and further outputs a pulse which makes a transition between said first and second levels when said charge voltage is lower than the charge completion voltage and higher than the flash possible voltage.

21. An electronic flashing device according to claim 18 wherein:

after the boosting operation of said boosting circuit is started, on the basis of said detecting signal from the charge voltage detecting circuit of the main condenser and within a predetermined time, said judging means judges a charge voltage to be higher than a charge completion voltage when the detecting signal is at a first constant output state within said predetermined time, judges a charge voltage to be lower than a flash possible voltage when the detecting signal is at a second constant output state different from said first constant output state and further judges a charge voltage to be higher than the flash possible voltage but lower than the charge completion voltage when the detecting signal is a pulse which makes a transition between the first and second output states.

22. An electronic flashing device according to claim 18 wherein:

said connecting point of said voltage dividing circuit and said connecting point of said series circuit are connected with each other through a diode.

23. An electronic flashing device for cameras comprising:

a boosting circuit for boosting a voltage of a power source battery in response to a boosting control signal;

a main condenser series circuit comprising a diode and main condenser connected to said boosting circuit;

a discharge tube connected to said main condenser;

a trigger circuit for exciting said discharge tube in response to a trigger signal;

a release signal outputting means for outputting a release signal;

a main condenser charge voltage detecting circuit connected to said main condenser series circuit and outputting a detecting signal in response to a charge voltage of the main condenser, said detecting circuit being formed of a series circuit comprising a pass condenser and voltage detecting device, a voltage dividing circuit comprising two resistances, said voltage dividing circuit being connected in parallel with said series circuit comprised of said pass condenser and voltage detecting device, a connecting point between the pass condenser and voltage detecting device of said series circuit and a connecting point between the two resistances of said voltage dividing circuit being connected with each other, said detecting circuit further including means for outputting a first detecting level when a voltage higher than a predetermined voltage is applied to said voltage detecting device;

a controlling means for outputting said boosting controlling signal to said boosting circuit and a trigger signal to said trigger circuit, said controlling means outputting a boosting controlling signal for a predetermined time when said release signal is output;

after a boosting operation of said boosting circuit is started, on the basis of a detecting signal from the charge voltage detecting circuit of the main condenser occurring within a predetermined time, a judging means coupled to an output of said voltage detecting circuit: judges a charge voltage to be higher than a charge completion voltage when the output is at said first output level within said predetermined time, judges a charge voltage to be lower than a flash possible voltage which is lower than said flash completion voltage when the output is at a second output level and further judges a charge voltage to be higher than the flash possible voltage and lower than the charge completion voltage when the output is a pulse which makes a transition between said first and second output levels; and an exposing operation inhibiting means for inhibiting an exposing operation when a charge voltage is judged by said judging means to be lower than the flash possible voltage.

24. An electronic flashing device for cameras according to claim 23 wherein:

when a release signal is output during a boosting operation of said boosting circuit, said controlling means includes means responsive to a release signal for stopping the boosting operation for a predetermined time, and thereafter outputting a boosting controlling signal to make said boosting circuit carry out another boosting operation for a given interval.

25. An electronic flashing device for cameras according to claim 23 wherein:

said connecting point of said voltage dividing circuit and said connecting point of said series circuit are connected with each other through a diode.

26. An electronic flashing device comprising:

a boosting circuit for boosting a voltage of a power source battery in response to a boosting controlling signal;

a main condenser series circuit comprising a diode and main condenser, said diode connecting said main condenser to said boosting circuit;

a discharge tube connected to said main condenser;

a release means outputting a release signal for initiating a photographing operation;

a detection initiation signal outputting means outputting a detection initiation signal responsive to said release signal for initiating a charge voltage of said main condenser;

a controlling means for outputting a boosting controlling signal to said boosting circuit, when a detection initiation signal is output from said detection initiation signal outputting means, for a predetermined time, said controlling means outputting said boosting controlling signal to enable said boosting circuit carry out a boosting operation;

a main condenser charge voltage detecting circuit connected to said main condenser series circuit and outputting a detecting signal in response to a charge voltage of the main condenser, said detecting circuit comprising a voltage detecting device having an output at a first level when a voltage higher than a predetermined voltage is applied to said voltage detecting device and a voltage applying circuit for applying to said voltage detecting circuit a voltage in response to a charge voltage of said main condenser, said voltage applying circuit, including a pass condenser coupled between said voltage detection circuit and a common terminal between said diode and said main condenser, applying a charge voltage of the main condenser to the voltage detection device in an initial period of starting a boosting operation of said boosting circuit and thereafter applying a divided voltage of a charge voltage of the main condenser to the voltage detecting device by a voltage divider circuit; and a judging means coupled to the voltage detecting circuit for judging a charge voltage state of the main condenser in response to one of three output states from said main condenser charge voltage detecting circuit, including said first state.

27. An electronic flashing device according to claim 26 wherein:

after a boosting operation of said boosting circuit is started, based on said detecting signal from the charge voltage detecting circuit of the main condenser within a predetermined time, said judging means judges a charge voltage to be higher than a charge completion voltage when the detecting device output is at said first level which is substantially constant within said predetermined time, judges a charge voltage to be lower than a flash possible voltage when the detecting device output is at a second level which is substantially constant and is different from said first constant output level and further judges a charge voltage to be higher than the flash possible voltage and lower than the charge completion voltage when the detecting device output is a pulse which makes a transition between said first and second levels.

28. An electronic flashing device for cameras according to claim 26 wherein:

when a release signal is output during a boosting operation of said boosting circuit, said controlling means includes means responsive to a release signal for stopping the boosting operation for a predetermined time, and thereafter outputting a boosting controlling signal to make said boosting circuit carry out another boosting operation during a given interval.

29. The electronic flashing device of claim 1 wherein said first state is a first predetermined level, said second state is a second predetermined level different from said first predetermined level and said third state is a pulse which makes a transition between said first and second levels.

30. A method for determining a charge state of a main condenser of an electronic flashing device comprising a boosting circuit for boosting a power source voltage; said main condenser being charged by said boosting circuit; a flash discharge tube for discharging a charge stored in said main condenser; a trigger circuit for exciting said flash discharge tube; a charge voltage sensing circuit connected to said boosting circuit and said main condenser, said charge voltage sensing circuit comprising a voltage dividing circuit of first and second resistances coupled across said main condenser; a pass condenser connected across one of said resistances and a series circuit comprising a voltage sensing device and a switching device connected in parallel across another one of said resistances, said method comprising the steps of:

(a) applying a boosting signal to activate said boosting circuit for a given period;

(b) monitoring said switching device during the given period of the boosting operation;

(c) judging the main condenser to be charged to a voltage higher than a predetermined charge completion voltage when said switching device produces a signal at a first signal level during the period of said boosting operation;

(d) judging a charge voltage across said main condenser to be at a voltage lower than a predetermined flash possible voltage when the switching device produces a signal at a second signal level different from said first level during the period of said boosting operation; and (e) judging a charge voltage of said main condenser to be at a voltage higher than said predetermined flash possible voltage and lower than said predetermined charge completion voltage when said switching device produces a pulse which makes a transition between said first and second levels during the period of said boosting operation.

31. The method of claim 30 further comprising the step of:

(f) initiating a flashing operation in response to a flashing operation request when one of said first and third signal conditions are present.

32. The method of claim 30 further comprising the steps of:

(f) deactivating the booster circuit for a predetermined time interval responsive to the occurrence of a flashing request signal developed by a release operation;

(g) reinitiating the activation of the boosting circuit for a given period upon termination of said predetermined time interval; and (h) repeating steps (b) through (e) to ascertain the charge condition of said main condenser.

33. An electronic flashing device according to claim 5 wherein said switching device comprises a control electrode and two main electrodes, said control electrode being connected to said voltage sensing device and one of said main electrodes being coupled to said micro-processor means for detecting.

34. An electronic flashing device according to claim 5 wherein said switching device has base, emitter and collector electrodes, said base electrode being coupled to said voltage sensing device and one of said emitter and collector electrodes being coupled to said micro-processor means for detecting.

35. An electronic flashing device according to claim 1 wherein said boosting signal has a given time interval, said switching device output being produced during said time interval.

36. An electronic flashing device according to claim 1 wherein said micro-processor includes means for enabling a trigger signal for operating said trigger circuit when one of said first and third signal states is generated during the period of the boosting operation.

37. An electronic flashing device according to claim 1 wherein said micro-processor includes means for preventing operation of said trigger circuit when said second signal state is present during the period of the boosting operation.

38. The method of claim 30 further comprising the step of:

(f) preventing a flashing operation when said second signal condition is present.

39. An electronic flashing device according to claim 4 wherein said voltage sensing device is a neon lamp having a predetermined conducting voltage which is less than said flash possible voltage.

40. An electronic flashing device comprising:

a power source boosting circuit for receiving a boosting controlling signal from a first signal line and boosting a voltage of a power source;

a main condenser charged with a boosted voltage of said power source boosting circuit;

a series circuit comprising a pass condenser and voltage sensing means, said series circuit being connected in parallel with said main condenser;

a voltage dividing means for applying a divided voltage of a charge voltage of said main condenser to a connecting point between said pass condenser and voltage sensing means;

a trigger means for producing a flash signal on a second signal line for flashing a flash discharge tube;

a switching means for detecting a current flowing from said voltage sensing means and outputting a charge voltage state of said main condenser through a third signal line, said switching means having an output for outputting: a first output level for enabling a flash of the flash discharge tube responsive to a divided voltage applied to said connecting point by said voltage dividing means when a voltage with which said main condenser is charged has reached a charge stopping voltage; a second output level different from said first output level when a charge voltage of said main condenser is lower than the flash permitting voltage; and a third output comprising a pulse which makes a transition between said first and second levels for enabling flashing of the flash discharge tube responsive to a voltage applied to said voltage sensing means through said pass condenser when a charge voltage of said main condenser is lower than the charge stopping voltage and higher than a flash permitting voltage.

41. An electronic flashing device according to claim 40 wherein:

the first output level of said switching means comprises a first substantially constant voltage level, the second output level comprises a second substantially constant voltage level different from the first constant voltage level and the third output level comprises a pulse which makes a transition between said first and second levels.

42. An electronic flashing device comprising:

a boosting circuit for receiving a boosting controlling signal and boosting a voltage of a power source during a given period;

a main condenser charged with a boosted voltage of said power source boosting circuit;

a series circuit comprising a pass condenser and voltage sensing device, said series circuit being connected in parallel with said main condenser;

a voltage dividing circuit having an output for applying to said voltage sensing device a divided voltage of a charge voltage of said main condenser;

a switching means for detecting a current flowing from said voltage sensing means and outputting a charge voltage state of said main condenser, said switching means outputting: a first output of a first state for enabling flashing of a flashing tube when a divided voltage of a given value at the output of said voltage dividing circuit and divided from the main condenser voltage is applied to said voltage sensing device during the boosting period, said given value of said divided voltage being a charge stopping voltage divided by said dividing circuit; outputting a second output of a level different from said first state when a voltage with which said main condenser is charged is lower than the flash permitting voltage; and outputting a third output comprising a pulse which makes a transition between said first and second states for enabling flashing of the flashing tube when a voltage is applied to said voltage sensing means through said pass condenser during the boosting period when a voltage with which said main condenser is charged is lower than the charge stopping voltage and higher than a flash permitting voltage.

43. An electronic flashing device according to claim 42 wherein:

the first output of said switching means comprises a first substantially constant voltage, the second output comprises a second substantially constant voltage different from said first constant voltage and the third output comprises a pulse which makes a transition between said first and second constant voltages.

44. An electronic flashing device according to claim 1 wherein said pulse has a first pulse portion which makes a transition between said first state and said second state and a second pulse portion which makes a transition from said second state back to said first state.

* * * * *